United States Patent [19]

Murphy

[11] Patent Number: 4,811,898

[45] Date of Patent: Mar. 14, 1989

[54] ELECTROSTATIC POWDER SPRAY GUN WITH ADJUSTABLE DEFLECTOR AND ELECTROSTATIC SHIELD

[75] Inventor: James C. Murphy, Broadview Heights, Ohio

[73] Assignee: Nordson Corporation, Westlake, Ohio

[21] Appl. No.: 99,059

[22] Filed: Sep. 21, 1987

[51] Int. Cl.[4] ..... B05B 5/04

[52] U.S. Cl. ..... 239/3; 239/11; 239/456; 239/514; 239/697; 239/706

[58] Field of Search ..... 239/3, 11, 697, 704, 239/706, 456-458, 505, 513-515

[56] References Cited

U.S. PATENT DOCUMENTS

| | | | |
|---|---|---|---|
| 425,246 | 4/1890 | Paget | 239/514 |
| 2,552,445 | 5/1951 | Nielsen | 239/456 |
| 3,317,138 | 5/1967 | Fraser | 239/697 |
| 3,448,925 | 6/1969 | Cross | 239/698 |
| 3,521,815 | 7/1970 | Szasz | 239/698 |
| 3,599,038 | 8/1971 | Skidmore | 317/3 |
| 3,608,823 | 9/1971 | Buschor | 239/698 |
| 3,667,674 | 6/1972 | Parsons et al. | 239/698 |
| 3,698,636 | 10/1972 | Szasz | 239/698 |
| 3,746,254 | 7/1973 | Duncan et al. | 239/697 |
| 3,819,115 | 6/1974 | Soderman | 239/698 |
| 3,844,486 | 10/1974 | Roberson | 239/456 |
| 4,169,560 | 10/1979 | Vöhringer | 239/600 |
| 4,182,490 | 1/1980 | Kennon | 239/3 |
| 4,216,915 | 8/1980 | Hengartner et al. | 239/698 |
| 4,235,381 | 11/1980 | Vila | 239/696 |
| 4,335,851 | 6/1982 | Hastings | 239/3 |
| 4,380,320 | 4/1983 | Hollstein et al. | 239/697 |
| 4,534,106 | 8/1985 | Simashkevich et al. | 29/613 |
| 4,543,710 | 10/1985 | Hastings et al. | 29/613 |
| 4,548,363 | 10/1985 | McDonough | 239/698 |
| 4,576,827 | 3/1986 | Hastings et al. | 427/27 |
| 4,634,058 | 1/1987 | Hollstein et al. | 239/697 |

FOREIGN PATENT DOCUMENTS

| | | | |
|---|---|---|---|
| 0203694 | 12/1986 | European Pat. Off. | 239/691 |
| 1954813 | 6/1971 | Fed. Rep. of Germany . | |
| 2811125 | 9/1979 | Fed. Rep. of Germany . | |
| 7113656 | 4/1973 | Netherlands . | |
| 952357 | 8/1982 | U.S.S.R. . | |
| 1236664 | 6/1971 | United Kingdom . | |
| 1241593 | 8/1971 | United Kingdom . | |
| 1406358 | 9/1975 | United Kingdom . | |

OTHER PUBLICATIONS

Airlub Company Limited.

"Control-A-Cloud", PCF Group Inc., Stamford, CT 06903.

Sames Electrostatic, Inc. Newsletter, PaintCon 1985 Edition.

*Primary Examiner*—Andres Kashnikow

*Assistant Examiner*—Karen B. Merritt

*Attorney, Agent, or Firm*—Wood, Herron & Evans

[57] ABSTRACT

An electrostatic spray device having a gun barrel formed with a powder delivery passageway connected to a source of particulate powder material, a nozzle mounted at the forward end of the gun barrel which is formed with a discharge opening for emitting coating particles, a deflector carrying an electrode which produces an electrostatic field in the path of the coating particles emitted from the discharge opening and a pattern adjustment sleeve carried by the gun barrel which is radially outwardly spaced from the deflector and discharge opening. Both the deflector and pattern adjustment sleeve are axially movable relative to one another, and relative to the discharge opening, to vary the width of the spray pattern of coating particle emitted from the discharge opening while controlling the concentration of the electrostatic field produced by the electrode, and, accordingly, the level of ionic bombardment of the powder particles, so as to obtain an optimum electrostatic charge on the coating particles emitted from the discharge opening.

15 Claims, 2 Drawing Sheets

ELECTROSTATIC POWDER SPRAY GUN WITH ADJUSTABLE DEFLECTOR AND ELECTROSTATIC SHIELD

FIELD OF THE INVENTION

This invention relates to electrostatic powder spray guns, and, more particularly, to an electrostatic spray gun which provides for variation of the width of the pattern of powder coating particles emitted from the spray gun toward an object to be coated while maximizing the electrostatic charge applied to the powder coating particles.

BACKGROUND OF THE INVENTION

In industrial finishing applications, coating particles are emitted from the spray device such as a spray gun toward an object to be coated. One type of coating material is a solid powder coating which is finely ground into powdered or particulate form for spraying onto parts in a manner similar to liquid paint. In electrostatic powder spray guns, one or more electrodes associated with the spray gun imparts an electrostatic charge to the coating particles as they are emitted toward the object to be coated. The object to be coated is maintained at an electrostatic potential different from that of the charged coating particles so that the coating particles are attracted to the article and deposited thereon with improved efficiency and coverage. The electrostatic charge maintains the powder upon the product for a sufficient time period to permit the powder to be heated so that it melts, and when subsequently cooled, the powder is firmly attached to the target substrate.

Electrostatic spray guns, particularly those designed for spraying particulate powder material, include a particle deflector mounted at the nozzle end of the spray gun. In one preferred form, the particle deflector is in the shape of a cone which is mounted axially in the flow path of the particulate powder material sprayed from a discharge opening in the nozzle of the spray gun. The particles impact the cone and are deflected radially outwardly into a conical spray pattern for deposition onto the article to be coated.

A primary goal of electrostatic spray guns is to maximize "transfer efficiency", i.e., the efficiency with which charged coating particles sprayed from the gun are deposited on an article to be coated. It has been disclosed in co-pending U.S. patent applications, Ser. No. 724,392, now abandoned entitled "Powder Spray Gun", filed Apr. 18, 1985 by Sharpless et al, and owned by the same assignee as this invention, and a related application, Ser. No. 07/072,780, filed July 13, 1987, and entitled "Particle Spray Gun", that the transfer efficiency of powder spray guns can be maximized in at least two ways. One way of increasing transfer efficiency is to form the particle deflector with a resistive sheet sandwiched between its forward and rearward ends, leaving exposed only the perimeter of the resistive sheet at the periphery of the particle deflector. The resistive sheet is electrically connected to a high voltage electrostatic cable and its perimeter functions as a multipoint electrode which is positioned by the particle deflector near the discharge opening of the nozzle of the gun directly in the path of the particle stream.

Additionally, as disclosed in patent applications Ser. Nos. 724,392 and 07/072,780, transfer efficiency is increased by providing an electrostatic shield at the forward end of the gun barrel. The electrostatic shield is disposed outwardly of the perimeter of the deflector where the corona charging points of the resistive sheet are located. In the preferred form disclosed in the above-identified applications, the electrostatic shield is formed by flaring the end of the nozzle in the region surrounding the forward end of the conical deflector, particularly the perimeter thereof, from which the corona charging points extend.

The electrostatic shield provided by the flared end of the nozzle in the prior art has the effect of preventing the charged particles emitted from the nozzle of the gun from being exposed or "seeing" grounded objects such as the handle of the gun, the gun mounting hardware, objects surrounding the gun in the spraying environment and the like. Because such grounded objects can provide an attraction to some of the charged particles, a corona current path can be set up between the charged particles at the electrode and one or more grounded objects which causes the available electric energy for charging at the deflector to be reduced by parasitic discharge. In the absence of an electrostatic shield to prevent such parasitic discharge, the reduction in available charging energy at the deflector results in a corresponding reduction in transfer efficiency.

The deflector of the type disclosed in the U.S. Ser. Nos. 724,392 and 07/072,780 applications has been employed in an electrostatic powder spray gun of the type disclosed in U.S. patent application Ser. No. 07/054,746, filed May 27, 1987, and entitled "Electrostatic Spray Gun Device and Cable Assembly" to Sharpo less et al. In the spray gun disclosed in that application, the deflector is directly connected to a high voltage electrostatic cable which is axially adjustable to vary the axial position of the deflector with respect to the powder discharge opening in the nozzle of the gun. Such adjustment of the deflector enables the width of the spray pattern produced by the electrostatic spray gun to be varied, while obtaining improved transfer efficiency from the multi-point electrode carried in the particle deflector.

One limitation of the electrostatic spray gun disclosed in the '746 application is that transfer efficiency can decrease when the width of the spray pattern is varied. For example, if the deflector is moved axially forwardly relative to the discharge opening in the nozzle in order to decrease the width of the spray pattern, the effect of the electrostatic shield provided by the flared end of the nozzle is reduced. This can result in parasitic discharge along a corona current path between the electrode and grounded objects in the environment in which the spray gun is operated and thus lessen the transfer efficiency of the spray gun.

SUMMARY OF THE INVENTION

It is therefore among the objectives of this invention to provide an electrostatic spray gun for spraying particulate powder material which permits adjustment of the width of the spray pattern while optimizing the electrostatic charge applied to powder coating particles emitted from the spray gun and thus maximizing transfer efficiency.

These objectives are accomplished in an electrostatic powder spray gun having a gun barrel formed with a powder delivery passageway communicating with a source of powder coating particles, and a nozzle mounted at the forward end of the gun barrel which is formed with a discharge opening for emitting the powder coating particles toward an object to be coated. The width of the pattern of coating particles emitted from the discharge opening in the nozzle is controlled by a particle deflector mounted at the forward end of the nozzle in the path of coating particles, and a pattern adjustment sleeve mounted at the forward end of the spray device which extends radially outwardly from the particle deflector and the discharge opening in the nozzle. The particle deflector and pattern adjustment sleeve are axially adjustable relative to one another, and relative to the discharge opening in the nozzle, to deflect the powder coating particles emitted from the discharge opening of the nozzle along different flow paths, which, in turn, varies the width of the spray pattern of coating particles deposited on an object to be coated.

The electrostatic charge applied to the coating particles emitted from the discharge opening in the nozzle of the spray gun herein is also controlled by the position of the deflector and pattern adjustment sleeve. The particle deflector carries an electrode which forms an electrostatic field in the powder flow path formed between the discharge opening in the nozzle and the particle deflector. The concentration of this electrostatic field within the powder flow path varies as the particle deflector is moved axially relative to the nozzle, i.e., as the radial dimension of the powder flow path formed between the particle deflector and the nozzle is varied. The pattern adjustment sleeve is positioned radially outwardly relative to the deflector, and relative to the discharge opening in the nozzle. In this position, during the operation of the spray gun, the pattern adjustment sleeve serves as an electrostatic shield between the electrode and charged coating particles produced thereat, and objects adjacent to or behind the spray gun having an electrical potential different from that of the electrode and such charged particles. The extent of the electrostatic shielding provided by the pattern adjustment sleeve is variable depending upon its axial position relative to the electrode.

In the presently preferred embodiment, an electrode in the form of a resistive sheet is mounted within the deflector so that the periphery of the resistive sheet is exposed forming a multi-point electrode. The deflector is carried at the forward end of a cable assembly which comprises a dielectric tube having a hollow interior filled with dielectric grease, within which a resistor and a portion of a high voltage electrostatic cable are mounted and electrically connected together. The electrode of the deflector is electrically connected to the electrostatic cable, and the deflector is carried at the forward end of the dielectric tube in the path of coating particles emitted from a discharge opening formed at the forward end of the spray device. Adjustment structure carried by the spray device is effective to move the cable assembly, and, in turn, the deflector, axially with respect to the spray device so as to vary the position of the deflector relative to the discharge opening of the spray device.

The pattern adjustment sleeve comprises a cylindrical-shaped member formed of dielectric material which is mounted upon the forward end of the spray device. In the preferred embodiment, an O-ring carried on the inner wall of the pattern adjustment sleeve slidably engages the outer surface of the spray device to permit axial movement of the pattern adjustment sleeve relative to the discharge opening of the spray device and the axially adjustable deflector.

Variation of the pattern width of coating particles discharged from the spray device is obtained by adjusting the axial position of the deflector and/or pattern adjustment sleeve. The deflector is axially adjustable with respect to the discharge opening in the nozzle, and this adjustment varies the space between the deflector and the nozzle and consequently the radial velocity of the powder discharged from the nozzle. The greater the radial velocity of the powder discharged from the nozzle, the wider the spray pattern. For example, with the deflector in a rearwardmost position, closest to the discharge opening in the nozzle, the smallest space is formed therebetween and therefore the highest radial velocity flow is generated. This produces a relatively wide conical-shaped pattern flow of coating particles past the deflector. As the particle deflector is moved forwardly relative to the discharge opening in the nozzle, the space between the deflector and nozzle widens and the radial velocity drops allowing the powder cloud to be drawn in more towards the center of the pattern by the low pressure zone which exists in front of the deflector.

The axial position of the pattern adjustment sleeve relative to the deflector and the discharge opening in the nozzle also controls the width of the spray pattern of coating particles on the object to be coated. For example, if the forward end of the cylindrical-shaped pattern adjustment sleeve is positioned rearwardly of the deflector, the width of the spray pattern upon the object to be coated is solely dependent upon the axial position of the deflector relative to the discharge opening in the nozzle. But as the forward end of the sleeve moves forwardly relative to the deflector, the particulate air flow through the gun impinges on the sleeve to turn the flow in a more forward direction. This "chokes down" or narrows the width of the spray pattern of coating particles applied to the object to be coated.

The electrostatic field produced and the charge applied to the coating particles is also controlled by the relative axial position of the pattern adjustment sleeve and the deflector. An electrostatic field is produced by the electrode which can be focused more forwardly by retracting the deflector into the nozzle or by moving the sleeve forwardly. These same adjustments will also, while focusing the field more forwardly, increase the concentration of the field in the vicinity of the space between the deflector and nozzle. The electrostatic charge which is applied to such coating particles is dependent upon the concentration of the electrostatic field and the residence time of such particles as they flow through the electrostatic field. By concentrating the electrostatic field, the amount of ionic bombardment of the powder particles is increased which increases the amount of charge transferred to the powder particles.

One way to concentrate the electrostatic field produced by the electrode is to adjust the position of the deflector relative to the discharge opening in the nozzle so that a relatively small powder flow path is formed therebetween through which the coating particles must flow. This has the effect of concentrating the electrostatic field in a relatively small area, but the coating particles flow through such a small area at a higher velocity and thus their residence time therein is reduced. The electrostatic field becomes less concentrated as the radial dimension of the powder flow path between the deflector and discharge opening in the nozzle increases, but at the same time the particles flow at a slower velocity therethrough which increases their residence time within the electrostatic field.

Depending upon the requirements of a particular application, the axial position of the deflector, and thus the electrode, relative to the discharge opening in the nozzle can be adjusted to balance the concentration of the electrostatic field within the powder flow path with the residence time of the coating particles therein so as to maximize the electrostatic charge applied to the coating particles.

The electrostatic field and the charge applied to the coating particles is also affected by the axial position of the pattern adjustment sleeve relative to the deflector and the charged coating particles produced thereat. The pattern adjustment sleeve functions as an electrostatic shield to prevent the development of corona current paths between the electrode and charged coating particles produced thereat, and objects located behind or adjacent to the electrode having a ground potential or having a substantially different potential than that of the electrode and coating particles. A corona current path occurs where the charged coating particles in the area of the electrode flow to a grounded or differently charged object, and this reduces the available electrical energy for charging at the electrode by parasitic discharge. The pattern adjustment sleeve provides an electrostatic shield which physically blocks or shields the charged coating particles from such grounded or differently charged objects and thus prevents the development of corona current paths therebetween.

The effectiveness of the pattern adjustment sleeve in preventing the development of corona current paths is dependent upon its position relative to the electrode in the deflector and the charged coating particles produced thereat. In its forwardmost position, the pattern adjustment sleeve is concentrically disposed about the deflector and substantially eliminates the development of any corona current paths between the charged coating particles and electrode, and a grounded or differently charged object adjacent to or behind the electrode. The trade-off in positioning the electrostatic shield in its forwardmost position is that the coating particles flowing outwardly from the powder flow path between the deflector and discharge opening of the nozzle are confined by the pattern adjustment sleeve, as discussed above, and thus the width of the pattern of coating particles on the object to be coated is reduced.

In order to increase the width of the pattern of coating particles on the object to be coated, the pattern adjustment sleeve must be moved rearwardly relative to the deflector and electrode so that the coating particles travel only a short distance, if any, along the inner wall of the pattern adjustment sleeve. While this increases the width of the spray pattern upon the object to be coated, the concentration of the electrostatic field is reduced because the pattern adjustment sleeve is no longer in position to as effectively shield the electrode and prevent the development of corona current paths between the charged coating particles in the area of the electrode and objects at ground or different potential than such charged coating particles.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
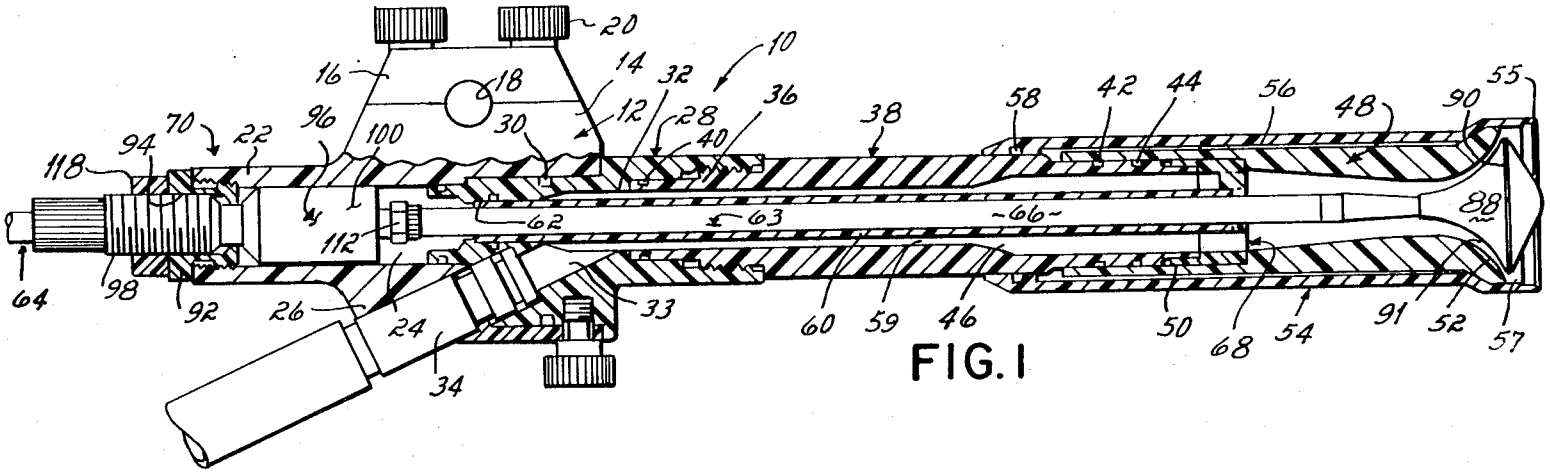
FIG. 1 is a cross sectional view of the electrostatic powder spray gun of this invention.

Referring now to FIG. 1, a spray gun 10 for spraying particulate powder material is illustrated which is disclosed in detail in U.S. patent application Ser. No. 07/099495, filed simultaneously herewith, and entitled "Powder Spray Gun For Quick Color Change Systems", which is assigned to the same assignee as this invention. Reference should be made to the disclosure of that application for a detailed discussion of the construction of spray gun 10, which is incorporated by reference in its entirety herein.

For purposes of the present discussion, the spray gun 10 comprises a a mounting block 12 having a base 14 and a cap 16. The base 14 and cap 16 are each formed with a notch which together define a bore 18 adapted to receive a mounting rod (not shown) for supporting the powder spray gun 10. The base 14 and cap 16 are mounted to one another by screws 20.

The base 14 of mounting block 12 is formed with an inlet 22, a forward cavity 24 and a sleeve 26 which intersects the cavity 24. The term "forward" as used herein refers to the righthand portion of the spray gun 10 as viewed in FIG. 1, and the term "rearward" refers to the lefthand portion thereof.

A rearward barrel member 28 is slidably mounted within the cavity 24 of mounting block 12 where it is secured along the cavity wall by an 0-ring 30 carried on the outer surface of rearward barrel member 28. The rearward barrel member 28 is formed with a throughbore 32, and an angled bore 33 which aligns with the sleeve 26 in the base 14 of mounting block 12. A powder supply tube 34 is inserted through the sleeve 26 in the mounting block 12 and into the angled bore 33 of rearward barrel member 28. The powder supply tube 34 is effective to introduce particulate powder material through the angled bore 33 into the throughbore 32 of the rearward barrel member 28.

The forward end of the rearward barrel member 28 is internally threaded to receive mating threads on the rearward end 36 of a forward barrel member 38. The outer surface of the forward barrel member 38 carries an O-ring 40 at its rearward end 36 which engages the rearward barrel member 28. A pair of O-rings 42, 44 are carried on the outer surface of forward barrel member 38 at its forward end. The forward barrel member 38 is formed with a throughbore 46 which is in axial alignment with the throughbore 32 of rearward barrel member 28 and forms a powder flow passageway therewith for transmitting particulate powder material from the powder supply tube 34 toward the forward end of the spray gun 10.

A nozzle 48 is slidably received on the forward end of forward barrel member 38 and is retained in position thereon by frictional engagement with the O-rings 42, 44. The nozzle 48 has a throughbore 50 which forms a flared discharge opening 52 at the forward end thereof.

A powder adjustment sleeve 54 having a throughbore 56 is concentrically disposed about the nozzle 48 and slidably received on the forward end of forward barrel member 38. The powder adjustment member 54 is retained in position on the outer surface of the forward barrel member 38 by engagement of an O-ring 58 therebetween which is carried within a groove formed in the wall of powder adjustment member 54.

An axial powder flow passageway 59 is therefore formed between the rearward and forward ends of the spray gun 10 by the throughbores in the rearward barrel member 28, forward barrel member 38 and nozzle 48. A barrel liner 60 extends axially within this powder flow passageway 59 which is mounted at its rearward end to a seat 62 formed in the rearward barrel member 28. The barrel liner 60 receives and supports a cable assembly 63 which comprises a high voltage electrostatic cable 64 mounted within the hollow interior of a dielectric cable liner 66. See FIG. 2. The forward end of the cable liner 66 is concentrically supported relative to the throughbore 56 of nozzle 48 by a spider mount 68 carried on the forward end of the forward barrel member 38. The rearward end of the cable liner 66 and high voltage cable 64 are mounted to the inlet 22 of mounting block 12 by a cable adjustment assembly 70. The construction of the cable assembly 63 and the cable adjustment assembly 70 are disclosed in detail in co-pending application Ser. No. 07/054,746, filed May 27, 1987, and entitled "Electrostatic Spray Gun Device and Cable Assembly", invented by Sharpless et al which is incorporated by reference in its entirety herein.

Figure 2:
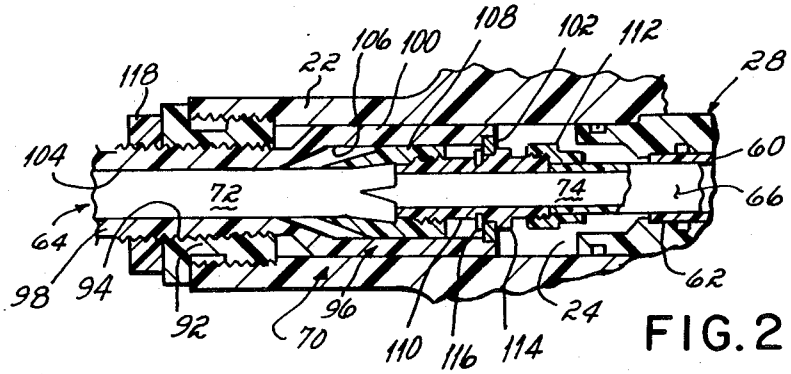
FIG. 2 is an enlarged cross sectional view of the rearward end of the powder spray gun illustrated in FIG. 1 showing the cable adjustment assembly in more detail.
Figure 3:
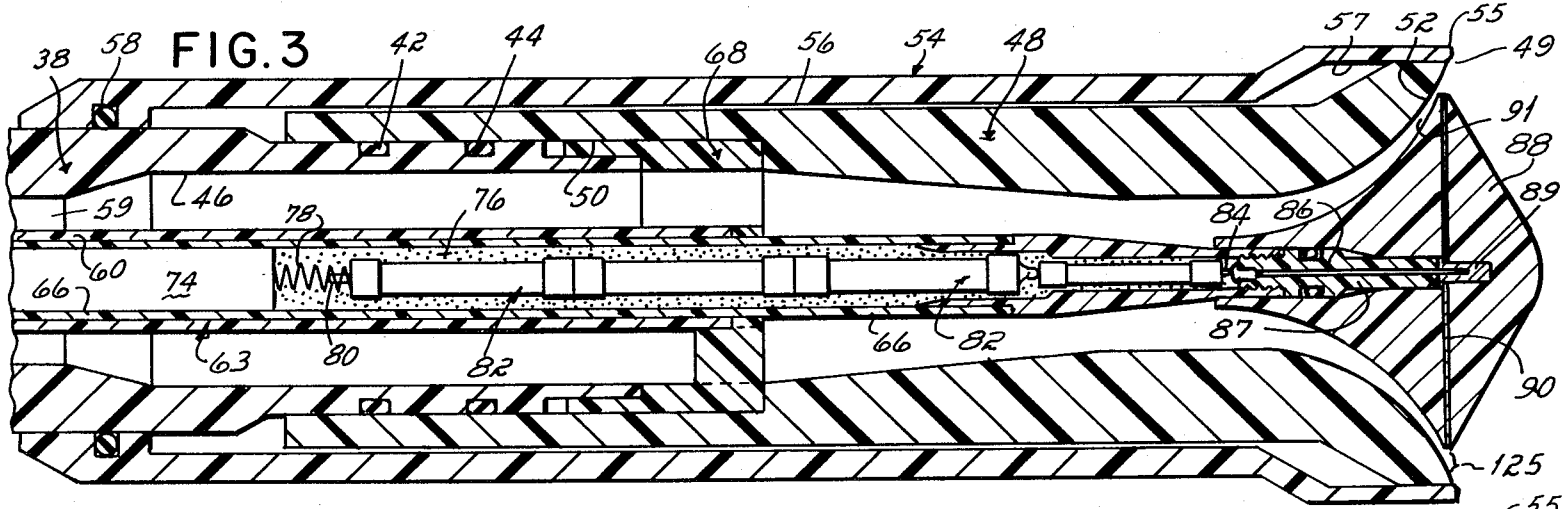
FIG. 3 is an enlarged view of the forward end of the spray gun shown in FIG. 1 with the deflector in a rearwardmost position and the electrostatic shield in a rearwardmost position.

The detailed structure of the cable assembly and cable adjustment assembly 70 form no part of this invention per se and are thus described in general terms. Referring now to FIGS. 2 and 3, the cable assembly herein is formed by stripping the forward end of the sheath 72 of cable 64 to expose its core 74 which is inserted within the hollow interior of the cable liner 66 whose interior is filled with dielectric grease 76. The cable core 74 electrically contacts a spring 78 soldered to the lead 80 of a series of resistors 82, which are also carried within the hollow interior of tube 66. The lead 84 on the opposite end of the resistors 82 is soldered to a tubular pin 86 which projects outwardly from the forward end of the cable assembly 63.

The forward end of the cable assembly 63 supports a deflector mount 87, which, in turn, mounts a particle deflector 88 having a charging electrode 90. The tubular pin 86 extends through the deflector mount 87 and electrically contacts the charging electrode 90 via a metal sleeve 89 in order to electrically connect the high voltage cable 64 to the charging electrode 90. The detailed structure of the particle deflector 88, and the connection between high voltage cable 64 and charging electrode 90, form no part of this invention per se and are therefore not disclosed in detail herein. The particle deflector 88 and charging electrode 90 are preferably of the type disclosed in U.S. patent application Ser. No. 07/072,780, filed July 13, 1987, and entitled "Particle Spray Gun", which is incorporated by reference in its entirety herein.

The cable assembly 63 mounts the particle deflector 88 and charging electrode 90 at the discharge opening 52 of nozzle 48 in the path of powder coating particles emitted therefrom. A generally donut or ring-shaped powder flow path 91 is thus formed between the deflector 88 and discharge opening 52 of nozzle 48 through which coating particles are emitted to form a conical-shaped powder spray pattern on an object to be coated. In accordance with a principal feature of this invention, the axial position of the particle deflector 88 relative to the discharge opening 52 of nozzle 48 is adjustable. This is achieved by movement of the high voltage cable assembly 63 in response to operation of the cable adjustment assembly 70.

Referring now to the lefthand portion of FIG. 1, the cable adjustment assembly 70 comprises a fixed nut 92 mounted to the inlet sleeve 22 of mounting block 12 which is formed with an internally threaded bore 94. A cable adjustor 96 has an externally threaded rearward end 98 which is received within the internally threaded bore 94 of fixed nut 92, and a forward end 100 of larger diameter having a radially inwardly extending annular ring 102. The rearward end 98 of cable adjustor 96 is formed with a throughbore 104 which increases in diameter at its forward end 106. The high voltage cable 64 is inserted through the cable adjustor 96 and its sheath 72 is removed so that only the core 74 of the cable 64 extends from the cable adjustor 96.

A nut 108 is mounted to the end of sheath 72 at the location where the sheath 72 is removed to expose its core 74. The nut 108 threadedly engages one end of a cable adaptor 110 to fixedly mount the cable adaptor 110 to the cable core 74. The opposite end of the cable adaptor 110 is threaded into a clamping nut 112 which is secured to the cable liner 66 by a compression ferrule-type joint (not shown), for example. The cable 64 and cable liner 66 are therefore fixed together through the cable adaptor 110 and movable as a unit within the barrel liner 60. The cable adaptor 110 is preferably formed with a radially outwardly extending shoulder 114 near its forward end. The annular ring 102 at the forward end 100 of cable adjustor 96 rests against the shoulder 114 of cable adaptor 110 and is retained in place thereon by a retaining ring 116.

The cable adjustment structure operates as follows. In order to move the cable 64 forwardly, for example, a lock nut 118, movable axially along the externally threaded surface of cable adjustor 96, is rotated out of engagement with the rearward surface of the fixed nut 92. The cable adjustor 96 is then rotated in one direction so that it moves axially with respect to the fixed nut 92. When rotated, the cable adjustor 96 is slidable with respect to the cable 64, nut 92, cable adaptor 110 and the internal bore of inlet sleeve 122 of mounting block 12. Thus an axial movement of cable adjustor 96 is transmitted to the cable 64 via the connection between the annular ring 102 of cable adjustor 96 and the shoulder 114 and retaining ring 116 of the cable adaptor 110. The shoulder 114 and retaining ring 116 of cable adaptor 110 permit rotation of the cable adjustor 96 but provide for axial movement of the cable adaptor 110, and, in turn, the cable 64 and cable liner 66, with the cable adjustor 96. Movement of the cable 64 and cable liner 66 in the opposite, axial direction is obtained by rotating the cable adjustor 96 in the opposite direction.

Figure 4:
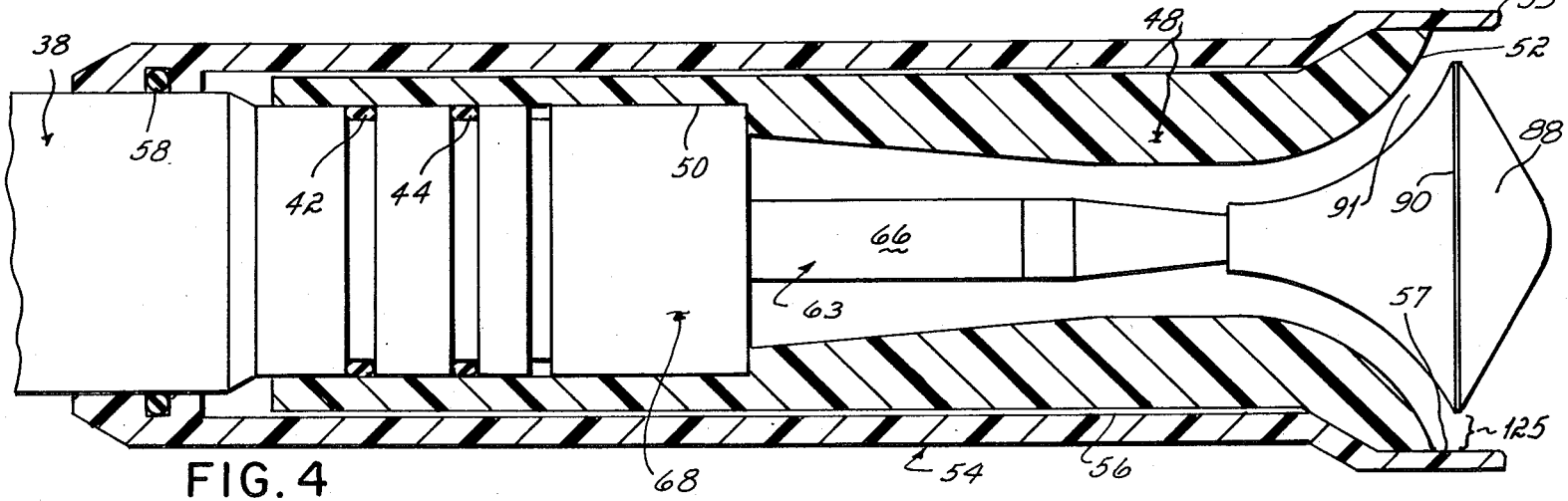
FIG. 4 is a view similar to FIG. 3 with the electrostatic shield in a forwardmost position and the deflector in a forwardmost position.

Referring now to FIGS. 3 and 4, enlarged views are provided of the forward end of spray gun 10 to illustrate the two extremes in the relative axial positions of the particle deflector 88, pattern adjustment sleeve 54 and nozzle 48. An important feature of this invention involves axial adjustment of the position of both the particle deflector 88 and pattern adjustment sleeve 54 relative to one another and relative to the discharge opening 52 of nozzle 48, in order to obtain the desired width of the spray pattern produced by coating particles emitted from the discharge opening 52 of nozzle 48, and to optimize the electrostatic charge imparted to such coating particles for a given pattern width.

Pattern Adjustment

As described above, the particle deflector 88 is movable with the cable liner 66 and high voltage cable 64 axially with respect to the discharge opening 52 in nozzle 48. The adjustment sleeve 54 is also axially adjustable along the forward end of spray gun 10 via the sliding connection between its O-ring 58 and the outer surface of forward barrel member 38. Both the particle deflector 88 and adjustment sleeve 54 contribute to the width of the spray pattern of coating particles applied to an object to be coated, and the contribution of each is dependent upon their axial position.

Referring to FIG. 3, the pattern adjustment sleeve 54 is moved to its rearwardmost position in which its forward end 55 is approximately flush with the forward end 49 of nozzle 48. In this position, none of the coating particles emitted from the discharge opening 52 of nozzle 48 contact the inner wall 57 of adjustment sleeve 54. As a result, the width of the spray pattern of such coating particles is entirely dependent upon the axial position of the particle deflector 88 with respect to the discharge opening 52.

The particle deflector 88 controls pattern width by altering the radial velocity of the powder coating particles flowing through the powder flow path 91. The greater the radial velocity of the particles, the wider the spray pattern. Changes in the particle velocity are obtained by varying the radial dimension 125 of the powder flow path 91 between the particle deflector 88 and nozzle 48. As the particle deflector 88 is moved rearwardly, toward the nozzle 48, the radial space or dimension 125 therebetween decreases and this increases the radial velocity of the particles flowing through the powder flow path 91. On the other hand, forward movement of the particle deflector 88 increases the radial dimension 125 and thus decreases particle velocity at constant flow rate.

It has been found that the flow of air-entrained powder coating particles past the deflector 88 creates an area of low pressure forwardly of the deflector 88 which tends to draw or suck powder coating particles emitted from the powder flow path 91 inwardly. Coating particles moving past the deflector 88 at higher radial velocity are less affected by this low pressure area, hence the spray pattern produced is wider than that of slower moving coating particles which are drawn inwardly by such low pressure area to a greater extent.

Referring now to FIG. 4, the pattern adjustment sleeve 54 is shown in its forwardmost position wherein its forward end 55 is spaced beyond the discharge opening 52 in nozzle 48. In this position of pattern adjustment sleeve 54, the coating particles flowing through the powder flow path 91 between particle deflector 88 and nozzle 48 impact the inner wall 57 of pattern adjustment sleeve 54. This causes the coating particles to change direction and follow a path generally parallel to the inner wall 57 of the pattern adjustment sleeve 54, which, in turn, narrows the width of the resulting spray pattern of coating particles on the object to be coated.

It is believed that the narrowing affect on the particle spray pattern provided by the adjustment sleeve 54 is maximum with the adjustment sleeve 54 in its forwardmost position relative to the nozzle 48 as shown in FIG. 4. In this position, a relatively long portion of the inner wall 57 of pattern adjustment sleeve 54 comes into contact with the coating particles, and this contact tends to lessen the velocity of the coating particles and direct them along a path substantially parallel to the inner wall of the adjustment sleeve 54.

As the adjustment sleeve 54 is moved rearwardly relative to the particle deflector 88 and discharge opening 52 of nozzle 48, the coating particles still impact the inner wall 57 of adjustment sleeve 54 but for a shorter distance and for a shorter period of time. The velocity of the coating particles is reduced to a lesser extent in this case and they tend to disperse radially outwardly from the forward end of the pattern adjustment sleeve 54 rather than be confined in a narrower path.

The particle deflector 88 also has an effect on the width of the powder spray pattern of coating particles with the pattern adjustment sleeve 54 in a forward position. As discussed above, the coating particles tend to form a narrower spray pattern when they travel a longer distance along the inside wall 57 of the pattern adjustment sleeve 54. If the particle deflector 88 is moved to its rearwardmost position with the pattern adjustment sleeve 54 in its forwardmost position, the coating particles must travel a substantial distance along the inner wall 57 of adjustment sleeve 54 and this narrows the resulting spray pattern. As the particle deflector 88 is moved forwardly relative to the nozzle 48 with the pattern adjustment sleeve 54 in the same axial position, at least a portion of the coating particles emitted from the powder flow path 91 between the nozzle 48 and particle deflector 88 travel a shorter distance along the inner wall 57 of adjustment member 54. As a result, a wider spray pattern is formed on the object to be coated.

Electrostatic Charging of Particles

In another aspect of this invention, the axial position of the particle deflector 88 and adjustment sleeve 54 relative to one another and relative to the flared discharge opening 52 of nozzle 48 affects the electrostatic charge applied to coating particles emitted from the spray gun 10.

The charging electrode 90 carried by the particle deflector 88 produces an electrostatic field through which the coating particles pass as they are emitted through the donut-shaped powder spray path 91 formed between the particle deflector 88 and nozzle 48. The electrostatic charge applied to the coating particles is a function of the concentration of the electrostatic field produced by the charging electrode 90 in the powder spray path 91, and the residence time of the coating particles within that electrostatic field. "Concentration" of the electrostatic field within the powder flow path 91 refers to concentration of ions therein, which, in turn, increases the number of collisions between the ions and powder coating particles to increase the electrostatic charge on the particles.

The axial position of the particle deflector 88 relative to the nozzle 48 affects both the residence time of coating particles in the powder flow path 91 therebetween, and the concentration of the electrostatic field in the powder flow path 91. Referring to FIGS. 3 and 4, as the deflector 88 moves rearwardly relative to the flared discharge opening 52 in nozzle 48 the radial dimension 125 of the powder spray path 91 therebetween decreases. See FIG. 3. For a given flow rate, as the radial dimension 125 of the powder flow path 91 between the particle deflector 88 and nozzle 48 decreases, the velocity of the coating particles increases and therefore the residence time of the coating particles within the electrostatic field produced by the charging electrode 90 is reduced. At the same time, the concentration of the electrostatic field in a particle flow path 91 increases as its radial dimension 125 decreases.

On the other hand, as the particle deflector 88 is moved axially forwardly, thus increasing the radial dimension 125 of the powder flow path 91 between particle deflector 88 and the nozzle 48, the velocity of the coating particles moving therethrough decreases at constant flow rate. But the concentration of the electrostatic field decreases across this powder flow path 91 of increased radial dimension 125.

In the preferred embodiment, the particle deflector 88 is therefore positioned an appropriate axial distance from the flared discharge opening 52 in nozzle 48, depending upon the requirements of a particular application, to obtain the desired balance between particle velocity and electrostatic field concentration for optimum charging of coating particles flowing through the particle flow path 91.

The axial position of the adjustment sleeve 54 relative to the charging electrode 90 also contributes to the concentration of the electrostatic field for charging the coating particles. The pattern adjustment sleeve 54 provides an electrostatic shield between the electrode 90 and charged coating particles produced thereat, and objects in the environment of the spray gun 10 which are at ground potential or a substantially different potential than the electrode 90. As discussed above, corona current paths can be developed between or differently charged objects and the electrode 90 in the event charged coating particles in the vicinity of the electrode 90 are allowed to be attracted to such charged objects. This reduces the available electrical energy for charging at the electrode 90 by parasitic discharge.

As the pattern adjustment sleeve 54 is moved forwardly relative to the electrode 90, it functions to increase the concentration of the electrostatic field produced in the powder flow path 91. This is because the pattern adjustment sleeve 54 progressively covers up or shields the electrode 90 from any peripheral objects at ground potential or a substantially different potential than electrode 90. The effectiveness of adjustment sleeve 54 as an electrostatic shield is dependent upon the extent to which it shields or covers the electrode 90 and charged coating particles produced thereat.

Although increased concentration of the electrostatic field produced by electrode 90 is obtained with the adjustment sleeve 54 in a forwardmost position, this has the effect of producing a relatively narrow spray pattern of coating particles on the object to be coated, as described above. In order to increase the width of the spray pattern, the pattern adjustment sleeve 54 must be moved rearwardly relative to the particle deflector 88. In turn, this reduces the effectiveness of the pattern adjustment sleeve 54 in shielding the electrode 90 from peripheral objects at different or ground potential.

The relative positioning of the pattern adjustment sleeve 54 and particle deflector 88 thus involves trade-offs between the width of the spray pattern desired, and the concentration of the electrostatic field required to impart an appropriate electrostatic charge to the coating particles. Because both the pattern adjustment sleeve 54 and particle deflector 88 are axially adjustable, a great deal of flexibility is provided with the spray gun 10 to optimize the coverage of coating particles on an object to be coated.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An electrostatic spray coating apparatus for spraying particulate powder coating material, comprising:

a spray device formed with a forward end and a powder flow passageway for transmitting particulate powder coating material;

a nozzle mounted within said powder flow passageway at said forward end of said spray device, said nozzle being formed with a discharge opening for emitting particulate powder coating material;

an electrode mounted to a particle deflector, said particle deflector and electrode being axially spaced from said nozzle in the path of particulate powder coating material emitted from said discharge opening of said nozzle, said particulate powder coating material contacting said deflector and being deflected radially outwardly along a powder discharge passageway formed by said axial space between said discharge opening of said nozzle and said deflector through an electrostatic field produced by said electrode within said powder discharge passageway;

means for adjusting said axial space between said particle deflector and electrode, and said discharge opening in said spray device, to vary the radial velocity of said particulate powder coating material discharged through said powder discharge passageway and to vary the concentration of said electrostatic field within said powder discharge passageway;

electrostatic shielding and particle deflecting means carried on said forward end of said spray device for shielding said electrode from objects having a different electrical potential than said electrode and for contacting particulate powder coating material discharged from said powder discharge passageway, said electrostatic shielding and particle deflecting means being axially movable along said forward end of said spray device relative to said particle deflector and said electrode and relative to said discharge opening of said spray device to vary the radial velocity of said particulate powder material ejected from said powder discharge passageway and to vary the degree of electrostatic shielding of said electrode.

2. The electrostatic spray coating apparatus of claim 1 in which said electrostatic shielding and particle deflecting means comprises a pattern adjustment sleeve slidably mounted upon said forward end of said gun barrel, said pattern adjustment sleeve being axially movable along said gun barrel relative to said electrode of said deflector and relative to said powder discharge passageway between a first position wherein at least a portion of said pattern adjustment sleeve is positioned radially outwardly from and forward of at least a portion of said electrode and in the path of particulate powder coating material emitted from said powder discharge passageway, and a second position wherein said pattern adjustment sleeve is spaced rearwardly of said electrode.

3. An electrostatic spray coating apparatus for spraying particulate powder coating material, comprising:

a spray gun having a gun barrel formed with a forward end and a powder flow passageway for transmitting particulate powder coating material;

a nozzle mounted within said powder flow passageway at said forward end of said gun barrel, said nozzle being formed with a discharge opening for emitting particulate powder coating material;

a cable assembly inserted within said powder flow passageway in said spray gun, said cable assembly including a tube having a hollow interior and a high voltage electrostatic cable secured within said hollow interior of said tube;

an electrode mounted to a particle deflector, said electrode being connected to said high voltage electrostatic cable, said particle deflector and electrode being mounted on said tube and axially spaced from said discharge opening of said nozzle in the path of particulate powder coating particles emitted therefrom, said particulate powder coating material contacting said deflector and being deflected radially outwardly from a powder discharge passageway formed by said axial space between said discharge opening of said nozzle and said deflector, said electrode producing an electrostatic field for imparting an electrostatic charge to the particulate powder coating material emitted from said powder discharge passageway;

cable adjustment means for axially moving said cable assembly within said powder flow passageway, said particle deflector and electrode being movable axially relative to said discharge opening in said nozzle in response to axial movement of said cable assembly to vary the radial velocity of said particulate powder coating material discharged through said powder discharge passageway and to vary the concentration of said electrostatic field within said powder discharge passageway;

electrostatic shielding and particle deflecting means carried on said forward end of said gun barrel for shielding said electrode from objects having a different electrical potential than said electrode and for contacting particulate powder coating material discharged from said powder discharge passageway, said electrostatic shielding and particle deflecting means being axially movable along said forward end of said gun barrel relative to said particle deflector and said electrode and relative to said discharge opening of said spray device to vary the radial velocity of said particulate powder material ejected from said powder discharge passageway and to vary the degree of electrostatic shielding of said electrode.

4. The electrostatic spray coating apparatus of claim 3 in which said electrostatic shielding and particle deflecting means comprises a pattern adjustment sleeve slidably mounted on said forward end of said gun barrel, said pattern adjustment sleeve being axially movable along said gun barrel relative to said electrode of said deflector and relative to said powder discharge passageway between a first position wherein at least a portion of said pattern adjustment sleeve is positioned radially outwardly from and forward of at least a portion of said electrode and in the path of particulate powder coating material emitted from said powder discharge passageway, and a second position wherein said pattern adjustment sleeve is spaced rearwardly of said electrode.

5. The method of varying the width of a spray pattern of particulate powder coating material emitted from a discharge opening formed in the nozzle of a spray device, comprising:

mounting a particle deflector in the path of coating particles emitted from the discharge opening formed in the nozzle of a spray device, said particle deflector being axially spaced from said discharge opening in said nozzle to deflect said particulate powder coating material radially outwardly along a powder discharge passageway formed by said axial space between said discharge opening in said nozzle and said deflector;

moving said particle deflector axially relative to said discharge opening in the nozzle to vary said axial space therebetween and thus vary the radial velocity of said particulate powder coating material discharged through said powder discharge passageway;

mounting a sleeve on said barrel of said powder spray gun, said sleeve being radially outwardly spaced from said particle deflector;

moving said sleeve to different axial positions relative to said powder discharge passageway formed between said deflector and said discharge opening in said nozzle to deflect particulate powder coating material moving therethrough and to thus vary the radial velocity of said particulate powder coating material.

6. The method of claim 5 in which said step of moving said particle deflector further comprises simultaneously maintaining said sleeve in a fixed axial position.

7. The method of claim 5 in which said step of moving said sleeve further comprises simultaneously maintaining said particle deflector in a fixed axial position.

8. The method of claim 5 in which said step of moving said sleeve comprises maintaining said deflector in a fixed axial position relative to said discharge opening in said nozzle and moving said sleeve axially away from said deflector and said discharge opening to decrease the radial velocity of said particulate powder coating material discharged from said powder discharge passageway and thus decrease the width of the spray pattern of particulate powder coating material deposited on a substrate.

9. The method of claim 5 in which said step of moving said sleeve comprises maintaining said deflector in a fixed axial position relative to said discharge opening in said nozzle and moving said sleeve axially toward said deflector and said discharge opening to increase the radial velocity of said particulate powder coating material discharged from said powder discharge passageway and thus increase the width of the spray pattern of particulate powder coating material deposited on a substrate.

10. The method of claim 5 in which said step of moving said deflector comprises maintaining said sleeve in a fixed, outermost axial position relative to said discharge opening in said nozzle and moving said deflector axially away from said discharge opening to decrease the radial velocity of said particulate powder coating material discharged from said powder discharge passageway and thus decrease the width of the spray pattern of particulate powder coating material deposited on the substrate.

11. The method of claim 5 in which said step of moving said deflector comprises maintaining said sleeve in a fixed, outermost axial position relative to said discharge opening in said nozzle and moving said deflector axially toward said discharge opening to increase the radial velocity of said particulate powder coating material discharged from said powder discharge passageway and thus increase the width of the spray pattern of particulate powder coating material deposited on a substrate.

12. The method of varying the concentration of an electrostatic field produced in the path of coating particles emitted from a discharge opening formed in the nozzle of a spray device, comprising:

mounting a particle deflector carrying an electrode axially in the path of coating particles emitted from the discharge opening of the nozzle of a spray device, the coating particles passing through an electrostatic field produced by said electrode within a powder discharge passageway defined by the axial space between said deflector and said discharge opening of said nozzle;

moving said deflector and electrode axially relative to said discharge opening in said nozzle to vary said axial space therebetween, the concentration of said electrostatic field throughout the cross section of said powder discharge passageway defined by said axial space varying as said axial space varies;

mounting a sleeve on said barrel of said powder spray gun, said sleeve being radially outwardly spaced from said deflector and electrode;

moving said sleeve axially relative to said deflector and electrode to place said sleeve in varying positions between said electrode and objects having a different electrical potential than said electrode, the concentration of said electrostatic field varying with the extent to which said sleeve electrostatically shields said electrode in each of said varying positions.

13. The method of claim 12 in which said step of moving said sleeve comprises maintaining said deflector and electrode in a fixed axial position relative to said discharge opening of said nozzle and moving said sleeve axially away from said discharge opening of said nozzle to increase the effectiveness of said sleeve in electrostatically shielding said electrode from objects having different electrical potential and thereby increasing the concentration of said electrostatic field produced by said electrode.

14. An apparatus for spraying particulate powder coating material in a variable pattern onto a substrate, comprising:

a spray formed with a forward end and a powder flow passageway for transmitting particulate powder coating material;

an electrode mounted at said forward end of said spray device;

a nozzle mounted within said powder flow passageway at said forward end of said spray device, said nozzle being formed with a discharge opening for emitting particulate powder coating particles;

a deflector axially spaced from said discharge opening in said nozzle in the path of particulate powder coating material emitted therefrom, said particulate powder coating material contacting said deflector and being deflected radially outwardly along a powder discharge passageway formed between said deflector and said discharge opening in said nozzle;

means for adjusting the axial position of said deflector with respect to said discharge opening in said nozzle to vary the radial velocity of said particulate powder coating material discharged through said powder discharge passageway therebetween and to thereby vary the width of the spray pattern of said particulate powder coating material deposited on a substrate;

sleeve means carried on said forward end of said spray device and being positioned radially outwardly relative to said deflector, said sleeve means being movable into the path of said particulate powder coating material emitted from said powder discharge passageway to vary the radial velocity of said particulate powder coating discharged through said powder discharge passageway and thereby vary the width of the spray pattern of said particulate powder coating material deposited on a substrate.

15. An electrostatic spray coating apparatus for spraying particulate powder coating material, comprising:

a spray device formed with a forward end and a powder flow passageway for transmitting particulate powder coating material;

a nozzle mounted within said powder flow passageway at said forward end of said spray device, said nozzle being formed with a discharge opening for emitting particulate powder coating material;

a particle deflector axially spaced from said nozzle in the path of particulate powder coating material emitted from said discharge opening of said nozzle;

a multi-point electrode formed of a resistive sheet mounted to said deflector so that the outer edge of said resistive sheet is exposed at the periphery of said deflector;

said particulate powder coating material contacting said deflector and being deflected radially outwardly along a powder discharge passageway formed between said deflector and said discharge opening in said nozzle and through an electrostatic field produced by said electrode within said powder discharge passageway;

means for adjusting said axial space between said particle deflector and said discharge opening in said spray device to vary the radial velocity of said particulate powder coating material discharged through said powder discharge passageway and to vary the concentration of said electrostatic field within said powder discharge passageway;

electrostatic shielding and particle deflecting means carried on said forward end of said spray device for shielding said electrode from objects having a different electrical potential than said electrode and for contacting particulate powder coating material discharged from said powder discharge passageway, said electrostatic shielding and particle deflecting means being axially movable along said forward end of said spray device relative to said particle deflector ad said electrode and relative to said discharge opening of said spray device to vary the radial velocity of said particulate powder material ejected from said powder discharge passageway and to vary the degree of electrostatic shielding of said electrode.

* * * * *